US008020534B2

(12) United States Patent
Lin et al.

(10) Patent No.: US 8,020,534 B2
(45) Date of Patent: Sep. 20, 2011

(54) CARBON CANISTER

(75) Inventors: Jhun Lin, Novi, MI (US); Mark Edward Hipp, South Lyon, MI (US); Christopher Michael Kersman, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 12/724,738

(22) Filed: Mar. 16, 2010

(65) Prior Publication Data

US 2011/0155107 A1 Jun. 30, 2011

(51) Int. Cl.
*F02M 33/02* (2006.01)

(52) U.S. Cl. ..... 123/519; 123/518; 96/131

(58) Field of Classification Search ..... 123/516, 123/518, 519, 520; 96/121, 131, 147, 139, 96/152; 55/318, 319
See application file for complete search history.

(56) References Cited

U.S. PATENT DOCUMENTS

| | | | | |
|---|---|---|---|---|
| 4,203,401 | A * | 5/1980 | Kingsley et al. | 123/520 |
| 4,280,466 | A | 7/1981 | Walters | |
| 4,451,435 | A * | 5/1984 | Holter et al. | 422/171 |
| 5,207,808 | A * | 5/1993 | Haruta et al. | 96/131 |
| 5,743,943 | A * | 4/1998 | Maeda et al. | 96/126 |
| 5,776,228 | A | 7/1998 | Meiller et al. | |
| 6,935,461 | B2 | 8/2005 | Marocco | |
| 7,008,471 | B2 * | 3/2006 | Koyama et al. | 96/131 |
| 7,159,579 | B2 * | 1/2007 | Meiller et al. | 123/518 |
| 7,214,258 | B2 | 5/2007 | Abidi et al. | |
| 7,246,608 | B2 | 7/2007 | Kano et al. | |
| 7,261,812 | B1 | 8/2007 | Karp et al. | |
| 7,267,112 | B2 | 9/2007 | Donahue et al. | |
| 7,322,343 | B2 | 1/2008 | Yamada et al. | |
| 7,353,809 | B2 | 4/2008 | Peterson et al. | |
| 2002/0020398 | A1 * | 2/2002 | Kimoto et al. | 123/519 |
| 2002/0124732 | A1 * | 9/2002 | Hara et al. | 96/131 |
| 2002/0174857 | A1 | 11/2002 | Reddy et al. | |
| 2003/0089345 | A1 | 5/2003 | Itou et al. | |
| 2005/0022672 | A1 * | 2/2005 | Loevenbruck et al. | 96/121 |
| 2005/0217645 | A1 * | 10/2005 | Fukaya et al. | 123/519 |
| 2007/0151560 | A1 | 7/2007 | Price et al. | |
| 2009/0320806 | A1 | 12/2009 | Lang et al. | |

FOREIGN PATENT DOCUMENTS

| | | | |
|---|---|---|---|
| JP | 5071432 | A | 3/1993 |
| JP | 6241131 | A1 | 8/1994 |

* cited by examiner

*Primary Examiner* — Willis Wolfe, Jr.
*Assistant Examiner* — Anthony L Bacon
(74) *Attorney, Agent, or Firm* — Julia Voutyras; Brooks Kushman P.C.

(57) ABSTRACT

A four-pass carbon canister includes a cover sealingly coupled to an injection-molded housing having a first chamber, a second chamber fluidly coupled to the first chamber, a baffle fluidly coupled to the second chamber, and a third chamber fluidly coupled to the baffle. The three chambers are filled with carbon pellets to absorb carbon pellets provided to the carbon canister from the fuel tank. The carbon canister is periodically purged by drawing fresh air into the carbon canister, with the fresh air desorbing the hydrocarbons and then provided to and consumed in an internal combustion engine.

16 Claims, 6 Drawing Sheets

CARBON CANISTER

BACKGROUND

1. Technical Field

The present disclosure relates to a carbon canister as part of a fuel vapor management system on an automotive vehicle.

2. Background Art

For many years, carbon canisters containing activated carbon have been used on automotive vehicles to reduce or prevent fuel vapors from the fuel tank escaping to atmosphere. In a typical application, the vapor storage canister has an opening to atmosphere coupled to both the vehicle fuel tank as well as the engine through the carbon absorptive material. A valve located at the atmospheric side of the carbon canister can be used to regulate the flow of air into the carbon canister. The activated carbon in the canister absorbs fuel vapors from the fuel tank during a storage mode, such as when the fuel tank is being filled. The stored fuel vapors are periodically purged from the carbon during a purge mode by passing air from atmosphere over the carbon to desorb the fuel, with the fuel vapor inducted by the engine and combusted during engine operation.

Some canisters include a number of parts which are assembled. It is desirable to reduce the number of parts to be assembled to reduce cost and parts complexity and to increase robustness of the carbon canister.

SUMMARY

A carbon canister includes a cover coupled to an injection-molded housing. The housing includes: a first chamber, a second chamber fluidly coupled to the first chamber, a baffle partially defined by a first wall separating the second chamber from the baffle, and a third chamber fluidly coupled to the baffle. Activated carbon is provided in the chambers to absorb hydrocarbons coming from a fuel tank prior to allowing other gases to exit to the atmosphere. The wall between the second chamber and the baffle has a plurality of apertures to fluidly couple the second chamber with the baffle while preventing carbon in the second chamber from entering the baffle. The carbon canister is generally cuboid shaped and configured to direct the flow through four generally parallel passes. The four passes include: first chamber, second chamber, baffle, and third chamber during a recovery mode and third chamber, baffle, second chamber, and first chamber during a purge mode. The housing includes: a recovery port fluidly coupling the first chamber with a fuel tank, a purge port fluidly coupling the first chamber with an intake manifold of an internal combustion engine with a purge valve disposed between the intake manifold and the first chamber, and a vent port fluidly coupling the third chamber with atmosphere.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 1:
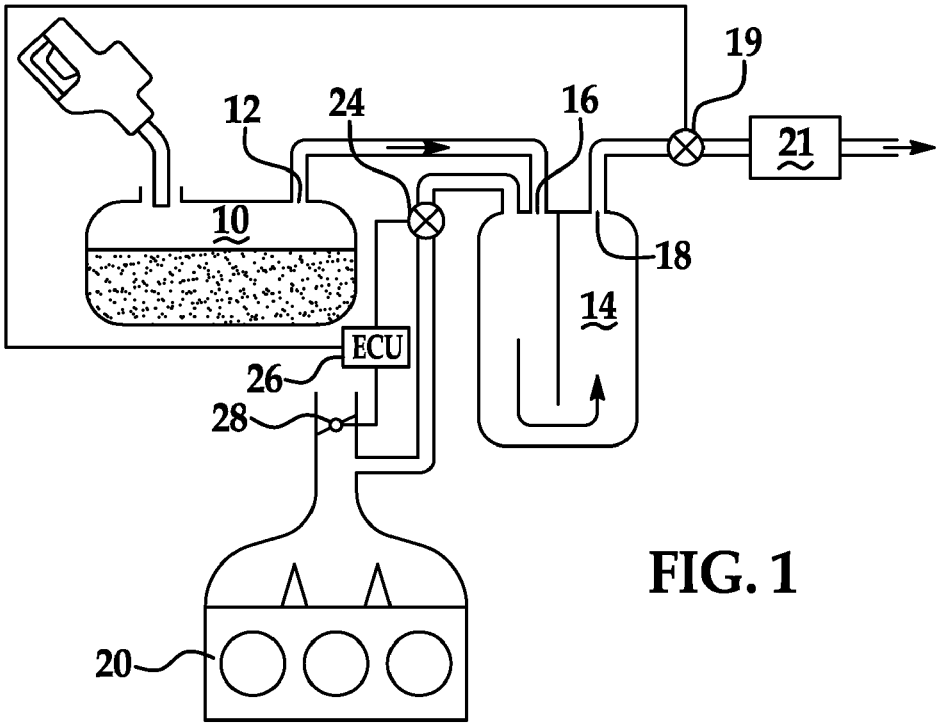
FIG. 1 is a schematic of a fuel vapor recovery system operating in a vapor recovery mode.

When an automotive fuel tank is filled, fuel vapor laden air is displaced by fuel. To prevent those fuel vapors from entering the atmosphere, fuel tank 10 is provided with a fuel vent 12 communicating to a carbon canister 14 via recovery port 16, as shown schematically in FIG. 1. Carbon canister 14 is filled with activated carbon to absorb fuel vapors. As gases containing fuel vapor pass through the bed of carbon, the fuel vapor is absorbed by the carbon pellets. Carbon canister 14 also has a vent port 18 communicating to the atmosphere. When such gases exit carbon canister 14 through vent port 18, all, or substantially all, of the fuel has been stripped from the gases displaced from the fuel tank by virtue of contact with the carbon pellets. Vent port 18 is coupled to a valve 19, which in some embodiments is an on-off valve, and to a filter 21. Valve 19 as well as valve 24 can be closed to isolate the system to perform a system leak test. Such operation as shown in FIG. 1, in which valve 19 is open and valve 24 is closed, is sometimes referred to as vapor recovery mode. In FIG. 1, a fuelling operation is shown. Vapor recovery also occurs when the vehicle is parked with a cap covering fuel tank 10. Daily temperature variations lead to lower molecular weight components of the fuel vaporizing during the heat of the day. The fuel vapors are absorbed in canister 14. At night the temperature drops and gases in the system contract pulling in fresh air through port 18.

Figure 2:
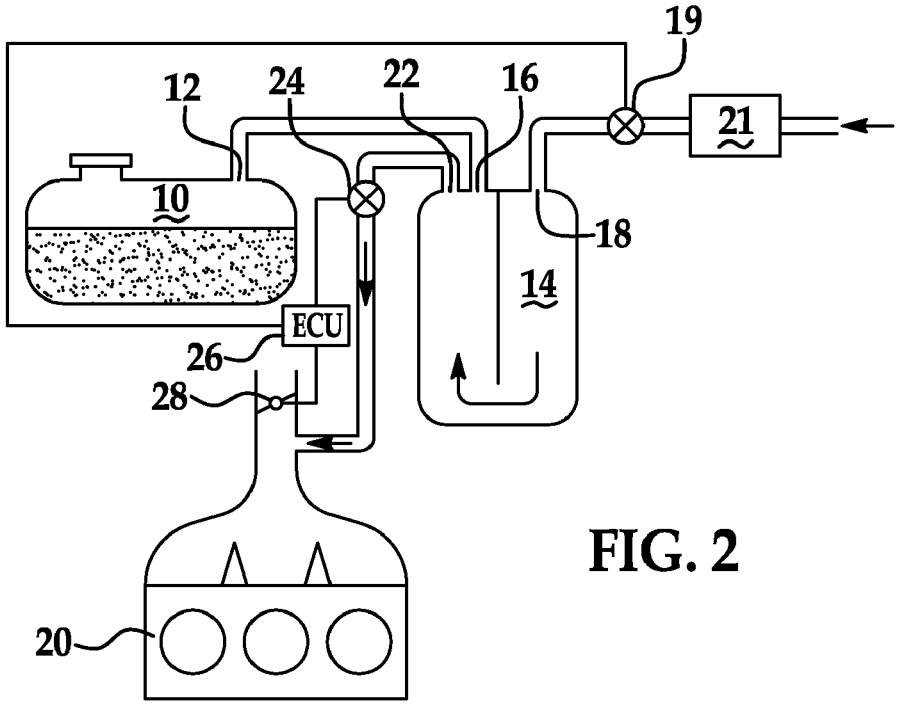
FIG. 2 is a schematic of a fuel vapor recovery system operating in a purge mode.

Activated carbon has a limited ability to store fuel and, therefore, must be purged so that they can once again absorb fuel vapor displaced from fuel tank 10. This is accomplished by pulling fresh air through the carbon pellet bed within carbon canister 14 and inducting that air, which contains desorbed fuel, through purge port 22 into an operating internal combustion engine 20, as shown in FIG. 2. The fuel vapors that are desorbed into the incoming air are combusted in engine 20 largely forming carbon dioxide and water before being exhausted from engine 20. Fresh air is drawn in through filter 21 and valve 19 (which is open during purge), and vent port 18 into canister 14. A valve 24 located upstream of engine 20 is controlled by electronic control unit 26 to control the flow of gases through carbon canister 14. The gases introduced through purge valve 24 are mixed with air entering an intake manifold 27 through throttle valve 28, which is also controlled by electronic control unit 26. Such operation as shown in FIG. 2 is sometimes referred to as purge mode. In the present disclosure, the intake system refers to fuel tank 10, carbon canister 14, and intake manifold 27 and the associated plumbing, valves, and controls of such valves.

Figure 3:
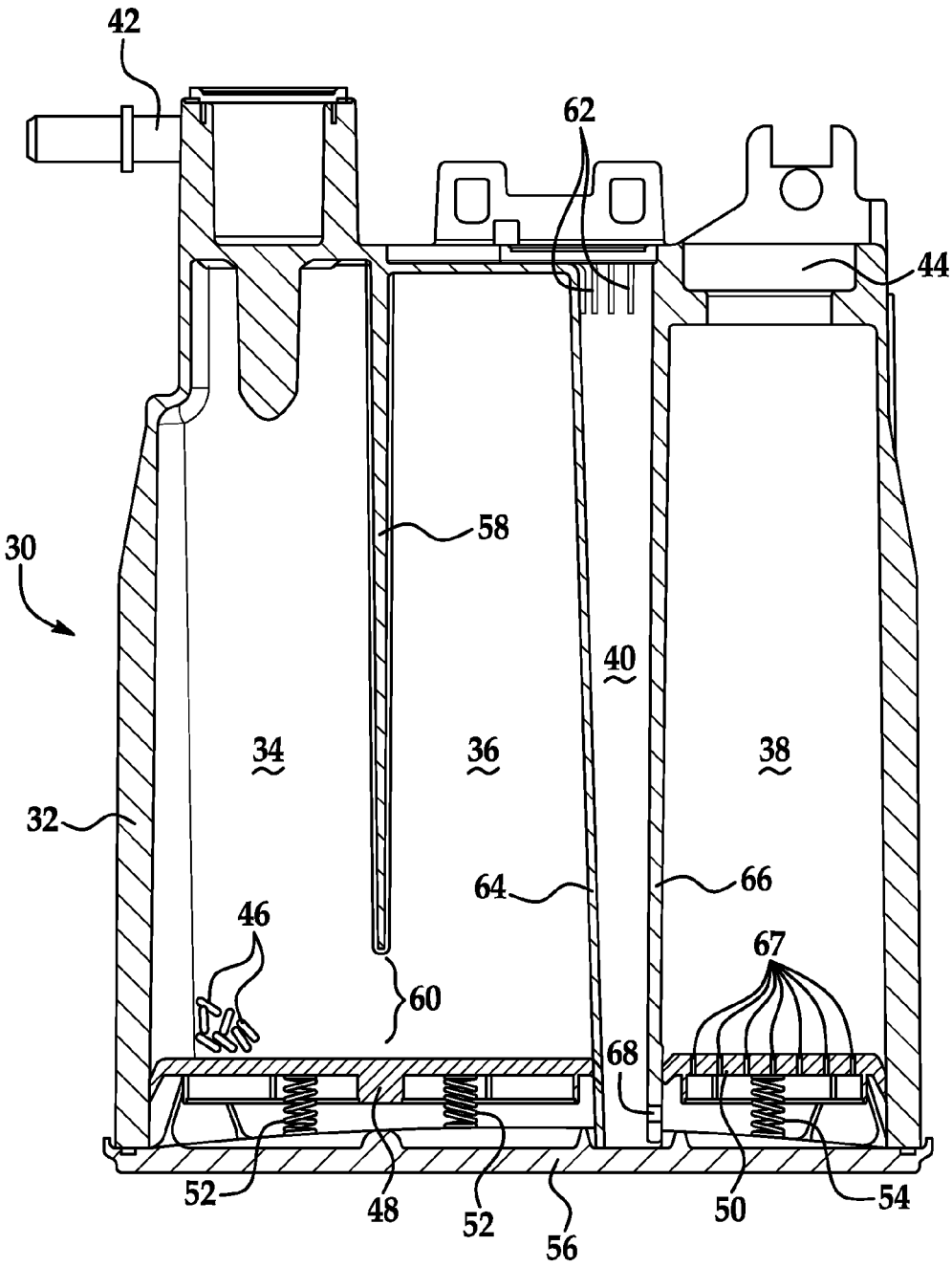
FIG. 3 is a cross section of a carbon canister according to an embodiment of the disclosure.

FIG. 3 shows a cross section of a carbon canister 30 according to an embodiment of the disclosure. A housing 32 of canister 30 defines first chamber 34, second chamber 36, and third chamber 38, and baffle 40, which is between second chamber 36 and third chamber 38. In FIG. 3, only a few typical carbon pellets 46 are shown in a corner of first chamber 34. However, in actual use, chambers 34, 36, and 38 are filled with carbon, possibly in pellet form. A collection port 42 is fluidly coupled to first chamber 34. A purge port is also fluidly coupled to first chamber 34 but not visible in the cross-sectional view of FIG. 1. A vent hole 44 fluidly couples third chamber with atmosphere. The carbon pellets in first and second chambers 34, 36 are held in place by retention plate 48. The carbon pellets in third chamber 38 are held in place by retention plate 50. A cover 56 is provided at the bottom of housing 32. Springs 52 are provided between cover 56 and retention plate 48. Springs 52 press against retention plate 48 so that carbon is packed within first and second chambers 34, 36. If carbon is allowed to jostle, they quickly break apart into smaller pieces. Similarly, a spring 54 presses between cover 56 and retention plate 50 to pack carbon pellets within third chamber 38.

A wall 58 is provided between first chamber 34 and second chamber 36 so that flow entering recovery port 42 (during vapor recovery mode) travels down most of the length of first chamber 34 before encountering an opening 60 connecting first chamber 34 with second chamber 36. Flow travels up second chamber 36. Slits 62 are provided near the top of baffle 40 to allow gases from second chamber 36 to enter baffle 40. In some applications, the carbon is cylindrical with a length that substantially exceeds a diameter of the pellets. Slits 62 are smaller in width than the diameter of the pellets or in the case of granular carbons sized to assure minimal intrusion of carbon into the baffle 40. In FIG. 3, slits are provided. However, any size and shape of aperture that will prevent the carbon particles from entering baffle 40 can be used. Flow continues down baffle 40. At the bottom of baffle 40, the wall 64 closer to second chamber 36 extends down to cover 56. As will be described in more detail below, wall 64 of baffle 40 is sonically welded to cover 56. The wall 66, which is closer to third chamber 38, does not extend down to cover 56, but instead has an opening 68 leading into the volume between cover 56 and retention plate 50. Retention plate 50 has orifices 67 of sufficiently small diameter to prevent carbon pellets from passing through retention plate 50. Flow from baffle 40 can pass through orifices 67 into third chamber 38. Flow exits third chamber 38 through vent port 44. The description of flow refers to a recovery process. The flow travels in reverse to that described above during the purge, except that the flow exits the purge port (not shown in this view), not the recovery port 42.

Figure 4:
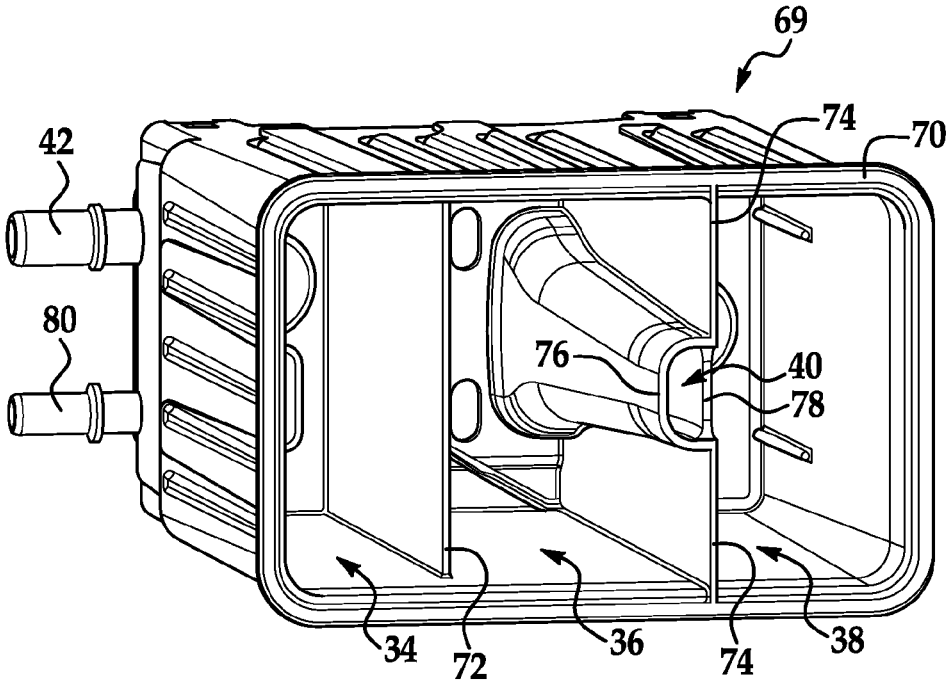
FIG. 4 is an end view of a carbon canister housing showing surfaces that are coupled to a cover.

In FIG. 4, a housing 69 of a carbon canister is shown in a perspective view for purposes of discussing the welds connecting a cover (cover not shown in FIG. 4) to housing 69. An outer edge 70 is welded to the cover. A wall 72 partially separating first chamber 34 from second chamber 36 does not extend to the end of housing 69 and thus does not abut the cover. The end of wall 72 is not welded to anything. A wall 74, 76 extends across outer edge 70 and extends to the end of housing 69. Thus, wall 74, 76 is welded to the cover. A first portion 74 of the wall separates second chamber 36 from third chamber 38. At the center of wall 74, baffle 40 is interposed. A second portion of wall 76 partially defines part of baffle 40 with wall 78 also partially defining baffle 40. Wall 78, does not extend to the end of wall 72 and thus does not abut the cover. First and second portions of walls 74 and 76 form a contiguous connection with the cover. The other wall 78, which defines baffle 40, does not extend to the cover. The opening due to wall 78 not meeting with the cover allows flow between baffle 40 and third chamber 38. The cover is described as being welded to particular surfaces of the housing. However, any suitable manner to sealingly couple the cover to the housing, such as using an adhesive, can be used.

Figure 5:
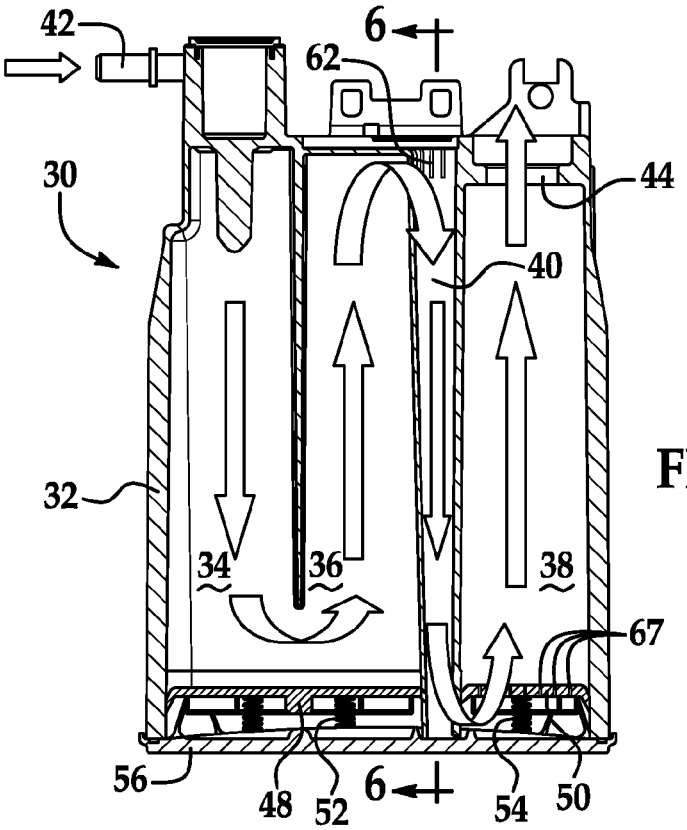
FIG. 5 is a cross-sectional view of a carbon canister showing the direction of flow during a recovery mode.

In FIG. 5, arrows indicate the direction of flow through canister 30 during recovery, i.e., when hydrocarbon laden gases from the fuel tank flow into canister 30. Recovery port 42 is coupled to a fuel tank and conducts the flow into first chamber 34, into second chamber 36, into baffle 40, into third chamber 38, and exiting out of vent port 44 to atmosphere. Flow from baffle 40 exits into a volume defined between cover 56 and retention plate 50. Retention plate 50 is provided with a plurality of apertures or orifices to allow flow from the volume below retention plate 50 into third chamber 38. The apertures or orifices in retention plate 50 prevent carbon in third chamber 38 from entering the volume between cover 56 and retention plate 50 and thus prevents carbon pellets from third chamber 38 from entering baffle 40.

Figure 6:
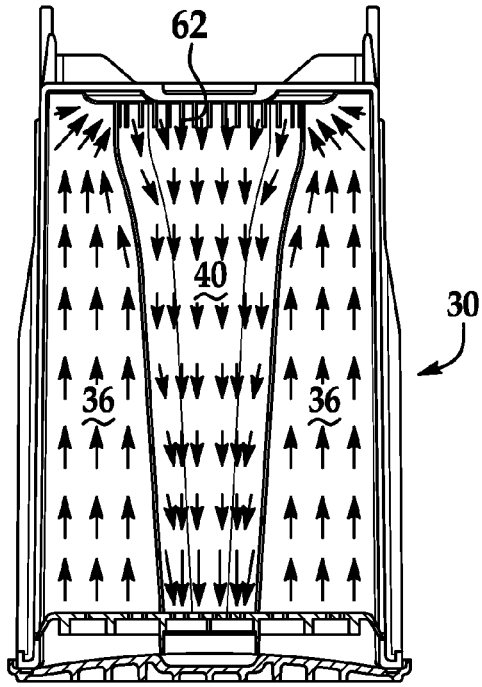
FIG. 6 is a cross-sectional view of the carbon canister of FIG. 5 through the baffle and part of the second chamber with arrows showing the direction of flow.

A cross section through baffle 40 is shown in FIG. 6. The volume of baffle 40 projects into a center portion of second chamber 36, as viewed in FIG. 6, such that second chamber 36 wraps around and contacts baffle 40. Flow travels upward from second chamber 36 into baffle 40 through slits 62. Alternatively, baffle 40 could project into a center portion of third chamber 38. If such an alternative were applied to the embodiment shown in FIG. 4, wall 74, 76 is generally straight and wall 78 wraps around baffle 40. The placement of the walls can be adjusted to provide the desired volumes for the chambers.

Figure 7:
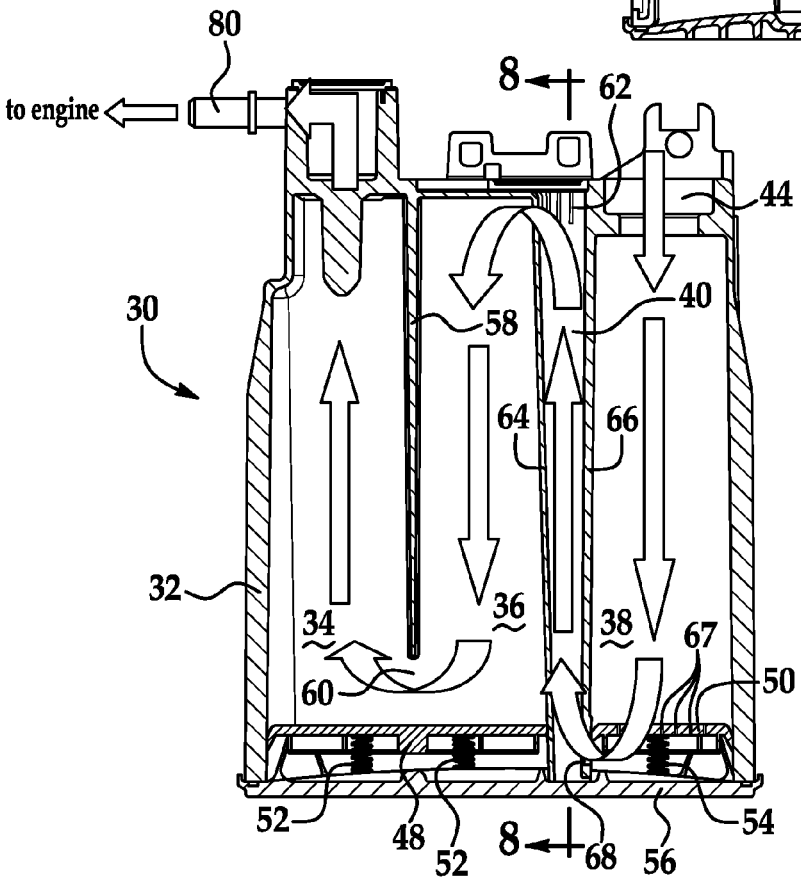
FIG. 7 is a cross-sectional view of a carbon canister showing the direction of flow during a purge mode.
Figure 8:
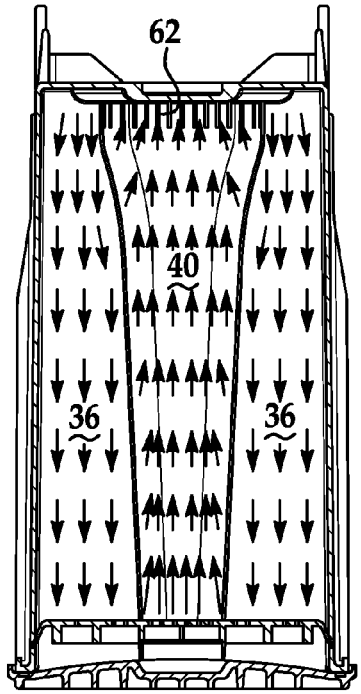
FIG. 8 is a cross-sectional view of a carbon canister of FIG. 7 through the baffle and part of the second chamber with arrows showing the direction of flow.

In FIG. 7, arrows indicate the direction of flow through canister 30 during purge, i.e., when fresh air is drawn into the canister to strip off hydrocarbons absorbed onto the carbon pellets and provide the hydrocarbon laden gases to the engine. Gases enter through vent port 44 into third chamber 38, into baffle 40, into second chamber 36, into first chamber 34, and out purge port 80 to the engine. Note that the cross section taken in FIG. 7 is offset in the vicinity of first chamber 34 with respect to the cross section taken in FIGS. 3 and 5 such that purge port 80 is visible; whereas, recovery port 42 is not visible in FIG. 7. A cross section through baffle 40 is shown in FIG. 8 with gases from baffle 40 exiting through slits 62 into second chamber 36. Again, in this cross-sectional view, second chamber 36 is on either side of baffle 40.

The purpose of the baffle is to lessen the amount of hydrocarbons exiting out the vent port into the atmosphere. The baffle serves as a barrier to diffusion between second and third chambers, as illustrated in FIGS. 9 and 10.

According to one embodiment of the canister, there are three chambers filled with carbon pellets and one baffle, providing four passes through the canister that the gases travel from atmosphere to being discharged into the intake (during purging) and from the intake to atmosphere (during recovery). The baffle contains no pellets. During recovery, when hydrocarbon-laden gases are drawn into the carbon canister, the hydrocarbons preferentially absorb onto the pellets which they first encounter, which are in first chamber 34 in FIG. 5. The concentration of hydrocarbons decreases along the length of travel within first chamber 34 and then along the length of travel within second chamber 36. Ideally, the gases leaving second chamber 36 and entering baffle 40 are hydrocarbon free. If not, the majority of the remaining hydrocarbons are absorbed by the pellets in chamber 38. The gradient in concentration during recovery evens out over time due to diffusion, such that the concentration of hydrocarbons within first and second chambers 34 and 36 eventually achieve a uniform concentration. The absence of pellets within baffle 40 creates a break in the direct physical contact between carbon pellets in second chamber and those in third chamber and therefore acts as a barrier to diffusion between second and third chambers 36 and 38. The concentration of hydrocarbons within third chamber 38 evens out, just as in chambers 36 and 38. However, because the concentration of hydrocarbons in third chamber 38 is usually substantially lower than that in first and second chambers 36 and 38, the ultimate concentration in third chamber 38, after diffusion of hydrocarbons, within third chamber 38 is much lower than it would be without a baffle acting as a diffusion barrier. The contrast is shown graphically in FIGS. 9 and 10.

Figure 9:
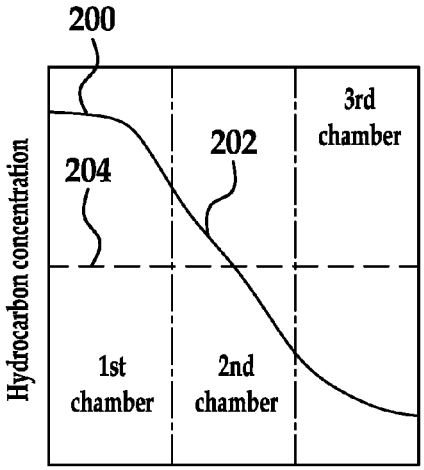
FIG. 9 is a graph of hydrocarbon concentration as a function of travel distance through a three-chamber carbon canister without a baffle during a recovery mode and after diffusion following the recovery mode.

In FIG. 9, hydrocarbon concentration in a three-chamber canister without a baffle during recovery is shown as a solid curve (200 and 202). The line segment 200 shows a portion of the first chamber being saturated. The carbon is limited in its capacity to absorb hydrocarbons. In this example, a portion of the first chamber can absorb no more hydrocarbons and the concentration of hydrocarbons in that section is constant at the saturation level. The concentration level drops through the remainder of chamber 1 through chamber 3, as indicated by curve 202. This type of concentration pattern can exist during a recovery of hydrocarbons. However, over time, the gradient in concentration drives diffusion, partially driven via direct physical contact between carbon pellets, such that at some point, the concentration throughout first, second, and third chambers average out and hydrocarbon concentration is roughly illustrated by dashed line 204.

Figure 10:
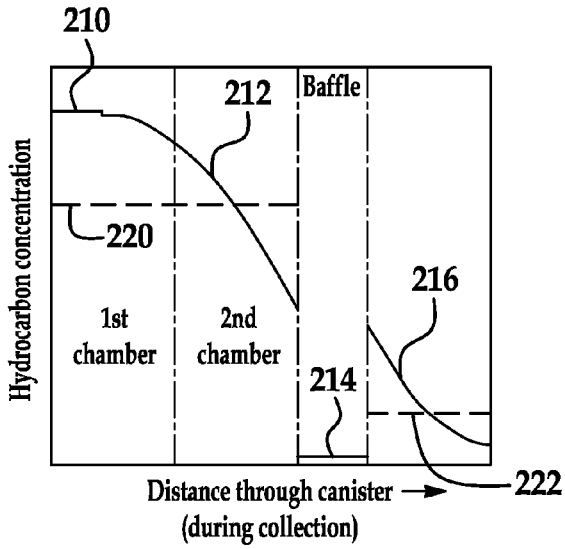
FIG. 10 is a graph of hydrocarbon concentration as a function of travel distance through a three-chamber canister with a baffle during a recovery mode and after diffusion following the recovery mode.

In FIG. 10, hydrocarbon concentration in a three-chamber canister with a baffle during recovery is shown (discontinuous solid curves 210, 212, 214, and 216). The concentration of hydrocarbons is saturated in part of the first chamber, as indicated by curve 210. The concentration in the remaining portion of the first chamber, as well as within second chamber, decreases, as shown by curve 212. The concentration of hydrocarbons in the baffle is very low and constant, as indicated by curve 214, because the air's hydrocarbon storage capacity is very limited in comparison to the hydrocarbon storage capacity of carbon pellets. Also, because there is no absorption of hydrocarbons within the baffle, there is no decrease in the concentration as the gases travel through the baffle. Concentration in the third chamber approximately picks up where concentration left off and decreases further. Again, if allowed time to diffuse, the hydrocarbons diffuse evenly throughout the particles in the third chamber to achieve an average value. However, hydrocarbons in the first and second chambers diffuse to achieve a constant level, but do not diffuse into the third chamber because the baffle provides a break in direct physical contact. The concentration of hydrocarbons, after time for diffusion, is shown as curve 220 in the first and second chambers and as curve 222 in the third chamber. Thus, the ultimate hydrocarbon concentration in the third chamber 222, which can leak out to the atmosphere, is much lower in FIG. 10 (with a baffle) than the concentration in the third chamber 204 in FIG. 9 (without a baffle).

Figure 11:
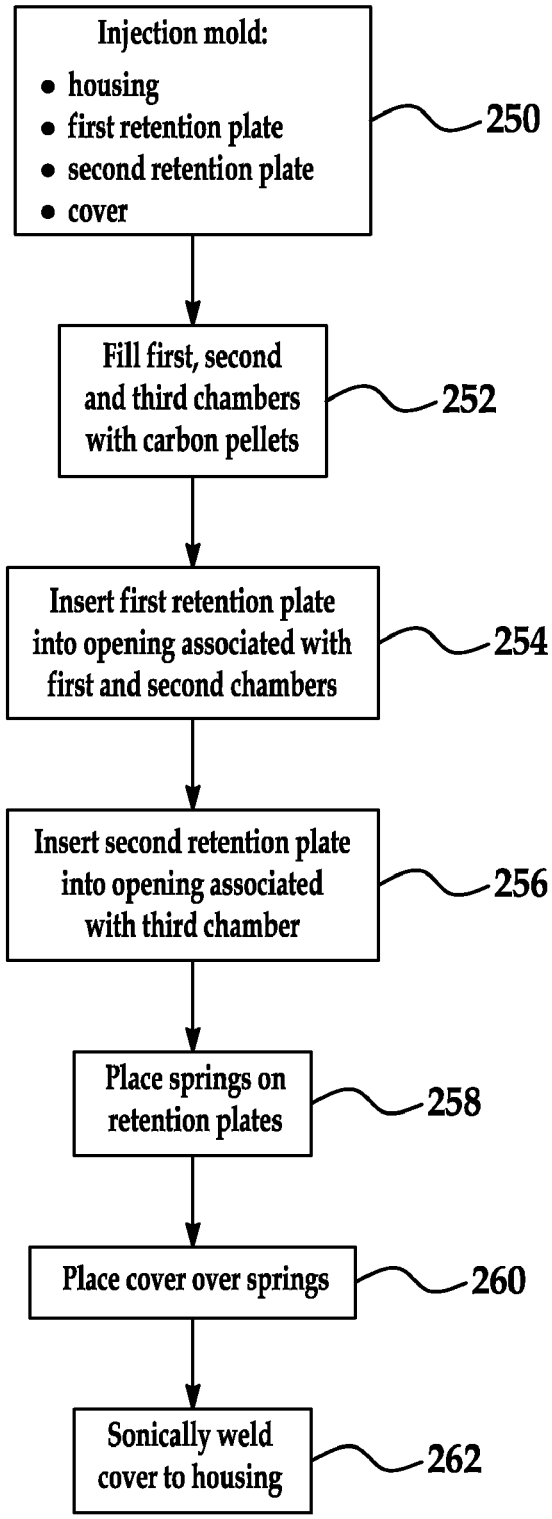
FIG. 11 is a flow chart of manufacture and assembly of a carbon canister according to an embodiment of the disclosure.

In FIG. 11, manufacture and assembly of a carbon canister according to an embodiment of the disclosure starts with injection molding the parts in 250. These include: a housing, a first retention plate, a second retention plate, and a cover. The housing is filled with carbon pellets within the first, second, and third chambers in 252. The first retention plate is installed into an opening in the housing proximate the first and second chambers in 254. The second retention plate is installed into an opening in the housing proximate the third chamber in 256. Springs are placed over the retention plates in 258. The cover is sonically welded to the housing in 262.

While the best mode has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments described herein that are characterized as less desirable than other embodiments or background art implementations with respect to one or more characteristics are not outside the scope of the disclosure and may be desirable for particular applications.

What is claimed is:

1. An intake system for an engine, comprising:

an intake manifold;

a carbon canister having a housing defining: a first chamber fluidly coupled to the intake manifold; a second chamber fluidly coupled to the first chamber; a baffle arranged in parallel between the second chamber and a third chamber, the walls of the baffle having apertures to fluidly couple the second and the third chamber with the baffle; and the third chamber having a retention plate covering one end wherein the third chamber extends substantially the same length as the first and second chambers.

2. The intake system of claim 1, further comprising:

a throttle valve disposed in the intake manifold wherein the first chamber is fluidly coupled to the intake manifold at a location downstream of the throttle valve.

3. The intake system of claim 1, the carbon canister further comprising:

a purge port provided on a first end of the carbon canister, the purge port providing an opening to fluidly couple the intake manifold and the first chamber wherein the first chamber and the second chamber are separated by a second wall, the second wall is a partial wall extending only a portion of the length of an interface between the first chamber and the second chamber, and an opening between the first chamber and the second chamber is located distally from the purge port.

4. The intake system of claim 1 wherein the carbon canister is generally cuboid shaped, the carbon canister further comprising:

a first retention plate pressed into one side of the carbon canister covering one end of the first and second chambers; and a second retention plate pressed into the one side of the carbon canister covering one end of the third chamber wherein the first retention plate and the second retention plates are separated by the baffle.

5. The intake system of claim 4, the carbon canister further comprising:

carbon pellets substantially filling first, second and third chambers;

a cover that is friction welded to the first side of the carbon canister, with the cover engaging with a periphery of the carbon canister;

at least one spring provided between the cover and the first retention plate to bias the first retention plate toward the first and second chambers; and a spring provided between the cover and the second retention plate to bias the second retention plate toward the third chamber.

6. The intake system of claim 1 wherein the carbon canister is generally cuboid, the carbon canister further comprising:

a purge port provided on one side of the carbon canister, the purge port fluidly coupling the first chamber with the intake manifold;

a recovery port provided on the one side of the carbon canister, the recovery port fluidly coupling a fuel tank and the first chamber; and a vent port provided on the one side of the carbon canister, the vent port fluidly coupling the third chamber and atmosphere.

7. The intake system of claim 6 wherein the carbon canister further comprises: a cover coupled to the housing at a side of the carbon canister opposite the one side.

8. The intake system of claim 7 wherein apertures in the first wall of the baffle are proximate the one end and the first wall is sealingly coupled to the cover to prevent flow between the second chamber and the baffle at a location proximate the cover.

9. The intake system of claim 1 wherein the carbon canister is generally cuboid and the longest dimensions of each of the first chamber, the second chamber, the third chamber, and the baffle are generally parallel.

10. A carbon canister, comprising:

an injection-molded housing with a cover, defining:

a first chamber;

a second chamber fluidly coupled to the first chamber; and a baffle arranged in parallel between the second chamber and a third chamber having a retention plate covering one end and extending substantially the same length as the first and second chambers, the surrounding walls having a plurality of apertures to fluidly couple the second and third chambers with the baffle.

11. The carbon canister of claim 10 wherein the carbon canister is generally cuboid shaped and is configured to direct the flow through four generally parallel passes, the four passes comprising: first chamber, second chamber, baffle, and third chamber during a recovery mode and the four passes comprising: third chamber, baffle, second chamber, and first chamber during a purge mode.

12. The carbon canister of claim 10 wherein the carbon canister is generally cuboid, the housing further comprising:

a recovery port fluidly coupling the first chamber with a fuel tank;

a purge port fluidly coupling the first chamber with an intake manifold of an internal combustion engine with a purge valve disposed between the intake manifold and the first chamber; and a vent port fluidly coupling the third chamber with atmosphere.

13. The carbon canister of claim 12 wherein the recovery port, the purge port, and the vent port defined in one side of the housing, the cover being on an opposite side from the one side.

14. The carbon canister of claim 13, the housing further comprising:

a first wall extending downwardly from the one side of the housing, the first wall defining an interface between the first and second chambers, and the first wall having an opening proximate the cover to allow flow between the first and second chambers;

a second wall extending downwardly from the one side of the housing and engaging with the cover, a first portion of the second wall defining an interface between the second and third chambers and a second portion of the second wall defining an interface between the baffle and the second chamber wherein the apertures are formed in the second portion of the second wall proximate the one end; and a third wall extending downwardly from the one side of the housing and having an opening proximate the cover to allow flow between the baffle and the third chamber.

15. The carbon canister of claim 10 wherein the chambers are configured to hold carbon having a smallest dimension greater than a largest dimension of the apertures so that carbon is prevented from entering the baffle.

16. A carbon canister, comprising:

an injection-molded housing, defining:

a first chamber;

a second chamber fluidly coupled to the first chamber;

a baffle arranged in parallel between the second chamber and a third chamber, the surrounding walls having a plurality of apertures to fluidly couple the second and the third chamber with the baffle, wherein the baffle has two walls that extend substantially the same length as the second chamber, with apertures sized to substantially limit movement of adsorbent material from entering the baffle; and the third chamber having a retention plate covering one end wherein the third chamber extends substantially the same length as the first and second chambers; and a cover coupled to the housing.

* * * * *